United States Patent [19]

Lyttle et al.

[11] Patent Number: 4,827,424

[45] Date of Patent: May 2, 1989

[54] METHOD AND APPARATUS FOR CONTROLLING THE OPERATION OF A SPIKED SHEET ADVANCING RELATIVELY TO A COMPACTABLE MASS

[75] Inventors: William J. Lyttle, Dewsbury; Stephen Kitchen, Heckmondwike, both of England

[73] Assignee: Haigh-Chadwick Limited, West Yorkshire, England

[21] Appl. No.: 894,949

[22] Filed: Aug. 8, 1986

[30] Foreign Application Priority Data

Aug. 10, 1985 [GB] United Kingdom ..... 8520130

[51] Int. Cl.[4] ..... D01G 13/00

[52] U.S. Cl. ..... 364/470; 19/80 R; 318/432

[58] Field of Search ..... 19/80 R, 81; 364/470, 364/476, 472; 318/432–434

[56] References Cited

U.S. PATENT DOCUMENTS 3,166,797 1/1965 Mayer, Jr. .
3,503,532 3/1970 Bouhon .
4,035,869 7/1977 Wilkes et al. ..... 19/80 R
4,194,269 3/1980 Reiche et al. ..... 19/81
4,377,021 3/1983 Peters ..... 19/81
4,380,095 4/1983 Walker et al. ..... 19/80 R
4,479,285 10/1984 Ragan .
4,541,144 9/1985 Hoeck ..... 19/81

FOREIGN PATENT DOCUMENTS 2107489 of 0000 United Kingdom .
1555487 of 0000 United Kingdom .

*Primary Examiner*—Allen MacDonald
*Attorney, Agent, or Firm*—Oblon, Fisher, Spivak, McClelland & Maier

[57] ABSTRACT

The operation of a spiked sheet 15 advancing relatively to a compactable mass 14 e.g. of textile fibres in a bin emptying arrangement in a blending line is controlled by measuring the resistance through compaction of the mass 14 to said relative advance and adjusting the operation so as to maintain the resistance substantially constant. The resistance can be measured e.g. by measuring the torque reaction on the motor 24 powering the spiked sheet.

21 Claims, 1 Drawing Sheet

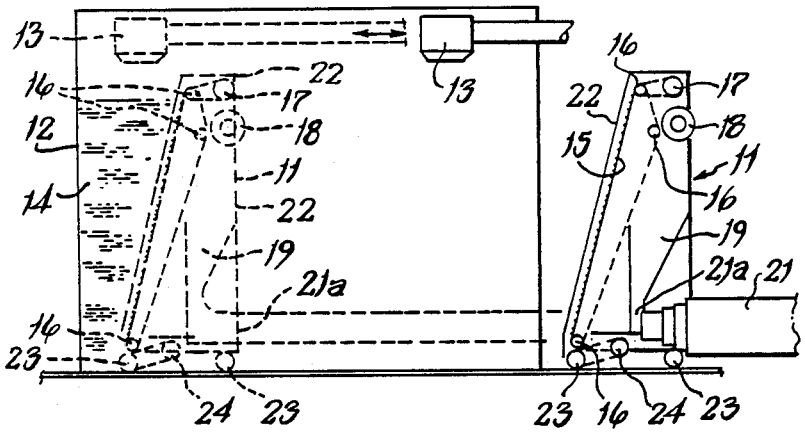
FIG.1
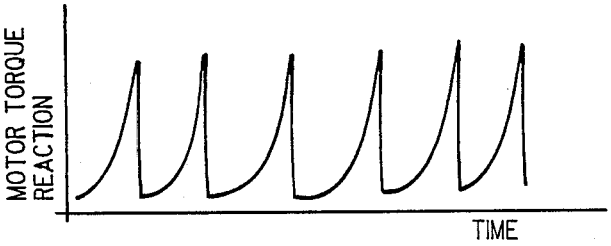
FIG.2 PRIOR ART
FIG.3
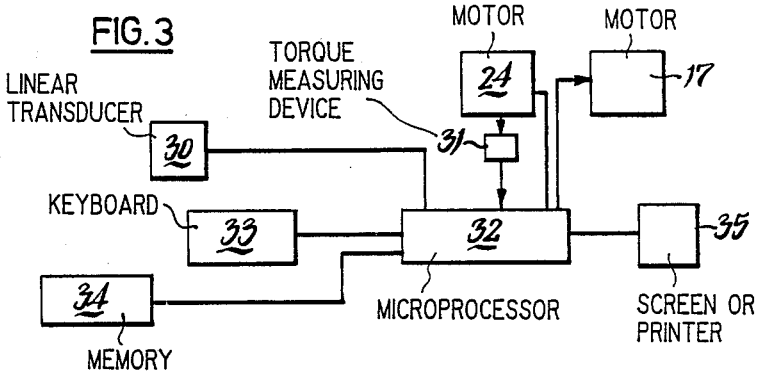

METHOD AND APPARATUS FOR CONTROLLING THE OPERATION OF A SPIKED SHEET ADVANCING RELATIVELY TO A COMPACTABLE MASS

BACKGROUND TO THE INVENTION

Field of the Invention

This invention relates to a method and apparatus for controlling the operation of a spiked sheet advancing relatively to a compactable mass.

Discussion of the Background

A principle use for the method and apparatus is in the control of bin emptying arrangements in textile blending lines. In one such arrangement, a mass of fibres is built up in a rectangular bin by a travelling cyclone arrangement that spreads the fibre evenly over the area of the bin. When the bin is full, a spiked sheet (i.e., a sheet having spikes thereon) advances through the bin from one thereof to the other trailing a telescopic suction tube by which fibre removed from the mass by the spiked sheet is transferred to, for example, a carding process.

In such known bin emptying arrangements, the motor drive advancing the spiked sheet into the mass is reversible, and the advancing is controlled by an operator, using this reversibility to relieve pressure built up by compaction of the fibre mass by the advancing spiked sheet. On backing off the spiked sheet from the mass, the resilience of the mass relieves the compaction, and the spiked sheet can once again be advanced into the mass. The operation proceeds thus, pilgrim-step fashion, with the spiked sheet advancing a little and then retracting a little then advancing a little further, and so on. During the backing-off periods, fibre is being removed from the mass at a substantially reduced and undesirably variable rate which represents a substantial loss of production. During advancing periods, the resistance to advance is increasing to a level very substantially above the mean level. This requires a drive arrangement capable of constant reversal and high loadings as well as of exerting high forces, all of which involves much more capital expense than would be required for a system which operated constantly at the mean take-off level. Power requirements as well as wear and tear on motors, transmissions and on the spiked sheet itself are all high. Yet the system remains the only system capable of dealing with the substantial quantities dealt with in high production textile operations.

The present invention provides a method and apparatus for controlling the operation of a spiked sheet advancing relatively to a compactable mass which represent a substantial improvement over those conventionally available.

SUMMARY OF THE INVENTION

The invention comprises in one aspect a method for controlling the operation of a spiked sheet advancing relatively to a compactable mass comprising the steps of measuring the resistance through compaction of the mass to the relative advance and adjusting the operation so as to maintain the resistance substantially constant.

The resistance to the relative advance may be measured by measuring an effect thereof on apparatus that powers the spiked sheet. This effect may be the torque reaction on a motor.

The rate of relative advance may be controlled, or the circulating speed of the spiked sheet, or both.

The rate of relative advance may be controlled so as to maintain the resistance substantially constant, and the circulating speed of the spike sheet controlled so as to give substantially time-constant rate of removal from the mass.

Control may be effected by a microprocessor which may be adapted to control the operation so as to effect a predetermined constant rate of removal of material from the mass, or to effect the removal of the entire mass in a given time, or at the highest rate consistent with the mechanical limitations of the apparatus.

The method is applicable equally to systems in which the spiked sheet is advanced into a fibre mass from one end of he bin, or systems in which the floor of the fibre bin is advanced towards the spiked sheet.

The relative advance may be reversible on detection of an increase in resistance to the relative advance above a predetermined limit - the intention would be, of course, that the operation would be controlled so that such a predetermined limit would not be reached and reversal of the relative advance would never be necessary. However, there may from time to time arise circumstances in which due to some unexpected factor a control system cannot cope. The size, power requirements and robustness of the motors and drives, may be advantageously reduced as compared with a conventional comparable system, and the predetermined limit will be substatially lower on that account.

The invention also comprises apparatus for controlling the operation of a spiked sheet advancing relatively to a compactable mass comprising apparatus for measuring the resistance through compaction of the mass to the relative advance and a controller adapted to adjust the operation so as to maintain the resistance substantially constant.

The apparatus for measuring the resistance may take the form of measuring torque reaction on a motor powering the spiked sheet.

The controller may include a microprocessor that is connected to the apparatus for measuring the resistance and that is used to control a motor powering the spiked sheet. The microprocessor may include an input arrangement by which a predetermined rate of removal of material from the mass may be set. The microprocessor may be programmable to control the operation according to some predetermined operating mode - several such modes may be programmed in and selected as desired. The microprocessor may be connected to a visual display unit, such as a screen or printer, to output information as to the state of operation of the apparatus, the time elapsed and the time still to go before completion of a predetermined operation and other desired information, and information can be input to other devices as well. For example, material consumption may be input to a stock control system. The microprocessor may have a memory adapted to store and recall operating information, whereby, for example, optimum conditions for operating on a particular fibre or fibre blend can be stored so as to be available for when such blend is next encountered.

The invention also comprises a bin emptying arrangement including a spiked sheet which advances relatively to a compactable mass, such as fibre, in the bin, including apparatus for controlling the operation as above described so as to maintain the resistance to advance substantially constant.

BRIEF DESCRIPTION OF THE DRAWINGS

Embodiments of apparatus and methods for controlling the operation of a spiked sheet advancing relatively to a compactable mass according to the invention will now be described with respect to the accompanying drawings, in which:

FIG. 1 is a diagrammatic side elevation of a bin emptying arrangement of a blending line for textile fibres, FIG. 2 is a graph showing the resistance as measured by the torque reaction on a driving motor, to the advancing of a spiked sheet, as a function of time in a conventional arrangement, FIG. 3 is a diagramatic illustration of a control system for the bin emptying arrangement illustrated in FIG. 1.

DETAILED DESCRIPTION OF THE PREFERRED EMBODIMENTS

FIG. 1 illustrates a bin emptying arrangement 11 of a bin 12 which is part of a blending line, not otherwise illustrated, for textile fibres.

Fibres are delivered into the bin from a travelling cyclone arrangement 13 which deposits them evenly over the floor of the bin 12 in a compactable mass 14, of which only a small amount is illustrated as it would appear close to the end of the emptying operation when the bin 12 is nearly empty.

The emptying arrangement 11 comprises a spiked sheet 15 trained over the rollers 16 one at least of which is driven by a motor 17. A doffer 18 is associated with the spiked sheet 15 to strip the fibres from the sheet and deliver them into a chute 19 or on to a mechanical conveyor which is above a telescopic suction outlet 21.

The spiked sheet 15 in its housing 22, to which the end 21*a* of the suction outlet 21 is attached, is mounted on wheels 23 driven by motor 24. The housing 22, when the bin 12 is filled with fibres from the cyclone arrangement 13, is driven from the starting position, as illustrated at the right hand end of the bin 12, towards the left hand end, the spiked sheet 15 being circulated on its rollers 16 to pick off fibres from the mass 14 and deliver them to the suction outlet 21.

Ordinarily, in conventional such equipment, the advancement of the spiked sheet 15 into the fibre effects a compaction of the mass 14 which increases the resistance of the mass to further advance and also to removal of fibre from the mass 14 by the spiked sheet 15. After only a short advance, the resistance builds up to such an extent as to preclude further advance, putting considerable stress on the drive. It is necessary to reverse the drive and back off the spiked sheet 15 to allow the mass 14 of fibres to recover elastically from its compaction, whereupon the advance can be continued. In emptying a large capacity bin multiple such cycles or "pilgrim steps" must be executed as will be apparent from FIG. 2 which shows a succession of cycles of torque reaction on the advancing motor 24 with time as the spiked sheet alternately advances into and is pulled back from the face of the mass 14. The reversals of direction are effected by an operator setting a number of timing devices which control the advance and reverse movements. The operation is prone to error due to inexperience or lack of correct historical information or other factors, which can put severe stress on the drive arrangement and lead to rapid burn-out of motors and high wear on gears, transmissions, bearings and especially the spiked sheet itself.

In addition, the supply of fibre to the suction outlet 21 is uneven, and this requires a buffer arrangement interposed between the bin and, say, a carding machine supplied from the suction outlet 21. Moreover, the equipment needs to be very robust because of the high forces imposed upon it, which involves considerable capital expense in the equipment and a large operating power requirement, even though the system is highly inefficient since it is much of the time delivering fibre at a much reduced rate and sometimes not at all.

FIG. 3 illustrates, by way of example only a control system for the bin emptying arrangement 11. The system comprises resistance measuring means, such as a motor torque measuring device 31, measuring the resistance through compaction of the mass 14 to the advance of the spiked sheet 15 relatively to the mass 14, and control means, such as microprocessor 32, adapted to adjust the operation so as to maintain the resistance substantially constant.

By "substantially constant" in this connection is meant, of course, substantially constant as compared to the large variations in resistance met within the conventional arrangement, but clearly, as with many operations, especially in the textile field, the more uniform the steps are carried out, the more uniform a finished product will be obtained, which is usually desirable. So it will in general be attempted on that account to make the resistance - as may be indicated as before by a torque reaction - as nearly constant as possible, so that a graph on the same basis as FIG. 2 would closely approximate a straight line.

A feed back loop arrangement could be used in which the torque measuring device 31 effected a change in the power supply to the motor 24 by known servo means. However, in the embodiment illustrated, the loop includes a microprocessor 32 which is also connected to control the motor 17 which circulates the spiked sheet 15.

The microprocessor 32 can be programmed in the usual way via a keyboard 33 or a disc, tape or cartridge unit (not shown separately) to control the motors 24 and 17 in accordance with predetermined programs, which can be selected from a menu by appropriate keyboard-entered commands as will all be readily understood by those skilled in modern control technology and requires no further elucidation here.

One mode of operation may require a predetermined constant rate of removal of material from the mass 14, and the appropriate program as selected by a keyboard command may increase the rate of circulation of the spiked sheet 15 by an appropriate control of the motor 17 simultaneously with a decrease in the rate of advance of the spiked sheet 15 into the mass 14 by an appropriate control of the motor 24, when the torque measuring device 31 indicates an increased resistance, until the resistance is again reduced to the predetermined level at which the normal speeds of motors 17 and 24 are known to remove material from the mass 14 at the desired rate - this rate being, perhaps, a keyboard entered quantity determining those normal settings in accordance with known operational achievements determined empirically. Information on such achievements can be stored in a memory unit 34 for recall when similar circumstances present themselves, for example when a similar blend is being processed under similar conditions.

Another mode of operation could be to effect removal of the entire mass in a given time, the motors 17 and 24 being controlled so as to effect a given rate of progression of the spiked sheet 15 from one end of the bin 12 to the other. Such rate of progression can be monitored by linear transducer 30. The housing 22 can run on rails (not shown) and have an electrical contact to a rail or to a separate resistance wire running parallel thereto to give a resistance output proportional to the distance travelled. Or a rotary incremental encoder can be attached to a wheel axle or operated at a fixed position by a wire attached to the housing 22 to input digital position information to the microprocessor 32.

Another mode of operation could be to effect removal from the mass 14 at the highest rate consistent with the mechanical limitations of the apparatus. In this mode, for example, the motor 24 could be driven at the highest speed consistent with the spiked sheet 15 being able, operated at a speed within its permitted range, to remove material from the mass 14 at a rate sufficient to prevent compaction interfering with the forward motion of the spiked sheet 15.

Information may be output from the microprocessor 32 in any of the usual ways, usually by a screen or printer 35. Such information can comprise available menus or repeat input information or the unit can display current operating information such, for example, as elapsed time since inception of an emptying operation, estimated time to completion of an emptying operation, delivery rate, efficiency (according to a predetermined standard) and so on.

Information, say on rates or quantities of delivery of material, power consumption and so on, can also be output to some other device such as a mainframe computer in a textile mill for stock control and finacial accounting purposes.

The resistance measuring means can be of any desired nature. It may, for example, be a motor torque measuring device 31 or a device that measures the current and phase lag of an induction motor, for example, from which the torque may be calculated, the microprocessor being programmed to interpret the information appropriately.

Safety measures can, of course, be built in. For example, if the resistance rises beyond a predetermined level in spite of the feed back arrangement, an audio or visual alarm may be raised and/or the motor 24 reversed so as to back off the spiked sheet 15 from the mass 14.

Also the microprocessor can provide control both upstream and downstream of the bin 12 in the processing line such, for example, as fans for the suction outlet 21 and the starting of a fresh supply of material to the bin 12 via the cyclone arrangement 13.

The term "spiked sheet" as used herein is intended to be understood generally as relating to any analagous device that removes fibrous or other material from a compactable mass, whether or not it comprises a sheet and whether or not it comprises spikes per se. Nor is the invention restricted to use with textile fibres - it may find important applications in the fields of mining, agriculture, food, such as flour and cereal processing, and so on wherever spiked sheets or their equivalents as are comprehended within that expression as used herein are employed.

What is claimed as new and desired to be secured by letters patent of the United States is:

1. A method for controlling advancing of a spiked sheet relative to a compactable mass, comprising measuring a resistance through compaction of said mass to said relative advance and adjusting advancing of said spiked sheet so as to maintain said resistance substantially constant.

2. A method according to claim 1, which comprises measuring the resistance to said relative advance by measuring an effect thereof on means powering said spiked sheet.

3. A method according to claim 2, in which said effect is a torque reaction on a motor.

4. A method according to claim 1, which comprises controlling a rate of said relative advance.

5. A method according to claim 1, which comprises circulating said spiked sheet, and controlling the circulating speed of the spiked sheet.

6. A method according to claim 1, comprising controlling the rate of said relative advance so as to maintain said resistance substantially constant, circulating the spiked sheet, and controlling the circulating speed of the spiked sheet so as to give a substantially time-constant rate of removal from said mass.

7. A method according to claim 1, which comprises adjusting said relative advance by a microprocessor.

8. A method according to claim 7, which comprises adjusting advancing so as to effect a predetermined constant rate of removal of material from the mass.

9. A method according to claim 7, which comprises controlling programming of said microprocessor so as to effect the removal of the entire mass in a given time.

10. A method according to claim 7, which comprises controlling said relative advance so as to effect the removal of material from the mass at a rate that has been predetermined to be the highest rate consistent with mechanical limitations of the apparatus.

11. A method according to claim 1, wherein the fibre is contained in a bin, further comprising controlling the removal of fibre from the bin upon advancing the spiked sheet into the fibre from one end of the bin.

12. A method according to claim 1, wherein the fibre is contained in a bin having a floor, further comprising the step of controlling the removal of fibre from the bin by advancing a floor of the bin towards the spiked sheet.

13. A method according to claim 1, further comprising reversing said relative advance upon an increase in resistance to said relative advance above a predetermined limit.

14. Apparatus for controlling the operation of a spiked sheet advancing relatively to a compactable mass comprising resistance measuring means for measuring a resistance through compaction of said mass to said relative advance and control means for maintaining said resistance substantially constant.

15. Apparatus according to claim 14, wherein said resistance measuring means comprise torque reaction measuring means for measuring torque reaction on a motor powering said spiked sheet.

16. Apparatus according to claim 14, wherein said control means comprises a microprocessor connected to said resistance measuring means for controlling motor means powering said spiked sheet.

17. Apparatus according to claim 16, said microprocessor comprising an input means for setting a predetermined rate of removal of material from said mass.

18. Apparatus according to claim 16, wherein said microprocessor comprises means for controlling the relative advance according to a predetermined operating mode.

19. Apparatus according to claim 16, wherein said microprocessor is connected a visual display unit to output information as to the state of operation of the apparatus, time elapsed and time still to go before completion of a predetermined operation and other desired information.

20. Apparatus according to claim 16, comprising memory means for storing and recalling advancing information.

21. Apparatus according to claim 14, comprising bin emptying means within which said spiked sheet is positioned.

* * * * *